US008051751B2

(12) United States Patent
Huang

(10) Patent No.: US 8,051,751 B2
(45) Date of Patent: Nov. 8, 2011

(54) LOCKABLE TORQUE-LIMITING DRIVER

(75) Inventor: Ching-Shu Huang, Tainan (TW)

(73) Assignee: Hern Juei Co., Ltd., Tainan (TW)

( * ) Notice: Subject to any disclaimer, the term of this patent is extended or adjusted under 35 U.S.C. 154(b) by 195 days.

(21) Appl. No.: 12/505,269

(22) Filed: Jul. 17, 2009

(65) Prior Publication Data

US 2011/0011220 A1 Jan. 20, 2011

(51) Int. Cl.
*B25B 23/143* (2006.01)

(52) U.S. Cl. ..... 81/475; 81/467; 81/480

(58) Field of Classification Search ..... 81/473–476, 81/467, 478, 480
See application file for complete search history.

(56) References Cited

U.S. PATENT DOCUMENTS 2,797,564 A * 7/1957 Bonneau et al. ..... 81/475
4,238,978 A 12/1980 Leone
7,013,769 B2 * 3/2006 Chen ..... 81/473
7,150,212 B2 * 12/2006 Lee ..... 81/475
7,197,968 B2 * 4/2007 Bubel ..... 81/475
7,272,999 B2 * 9/2007 Cutler et al. ..... 81/475
7,487,700 B2 2/2009 Cutler et al.

* cited by examiner

*Primary Examiner* — Hadi Shakeri
(74) *Attorney, Agent, or Firm* — J.C. Patents

(57) ABSTRACT

A lockable torque-limiting driver includes a body and a sleeve received in a sleeve chamber of the body and secured therein by recesses inside the body. The sleeve is provided with projecting edges on the outer wall to be respectively fitted in the recesses of the body, plural recessed grooves at the inner wall for fixing an upper cam, and female threads at the inner wall to be screwed with the male threads of a torque-limiting member, further disposed with plural positioning serrations at topside and a center chamber inside. The upper cam and a lower cam respectively have one-way serrations to be mutually engaged. The torque-limiting member is fixed with positioning projections to be actuated to move on the positioning serrations of the sleeve and give out sounds by which a user can know a torque limiting extent desired.

5 Claims, 8 Drawing Sheets

LOCKABLE TORQUE-LIMITING DRIVER

BACKGROUND OF THE INVENTION

1. Field of the Invention

This invention relates to a lockable torque-limiting driver, particularly to one provided with a sleeve having its upper edge disposed with a plurality of positioning serrations, and a torque-limiting member having its upper side fixed with positioning projections. To adjust torque of the torque-limiting driver, a user only has to turn the torque-limiting member with fingers to let the male threads of the torque-limiting member engaged with the female threads of the sleeve and thus, by the number of sounds produced by the positioning projections moving on the positioning serrations, an adjuster is able to know a desired torque-limiting extent, needless to employ any external tool for adjusting torque of the torque-limiting driver and able to carry out adjustment quickly and accurately.

2. Description of the Prior Art

A first conventional torque-limiting driver, as disclosed in a U.S. Pat. No. 7,487,700B2, titled "LOCKABLE TORQUE-LIMITING DRIVER AND METHOD", has an adjustment plug 60 and a locking plate 75 in a first preferred embodiment, or an adjustment plug 67 and a locking plate 80 in a second preferred embodiment, or an adjustment plug 67 and a locking plate 100 in a third preferred embodiment combined together. Thus, an adjuster can turn the locking plate together with the adjustment plug with fingers to change a combination extent between the adjustment plug and a sleeve 29 for carrying out adjustment of torque. After being adjusted, the torque can be kept unchangeable by having the serrations 79 OF the body-engaging portion 77 of the locking plate engaged with a pair of prongs 29A of the sleeve 29.

A second conventional torque-limiting driver, as disclosed in a U.S. Pat. No. 5,397,269, titled "TORQUE LIMITING CLUTCH AND ITS USES" has a closure block 76 secured at an inner side of the end of a housing 40. Thus, the locking torque of a driven member 50 can be decided by adjusting the extent that the closure block 76 is locked in the housing 40.

A third conventional torque-limiting driver, as disclosed in a U.S. Pat. No. 4,238,978, titled "TORQUE WRENCH", has an adjusting screw 36 installed at a lower side of the main body of a housing. Thus, the locking torque of a socket tool 18 can be changed by adjustment of the adjusting screw 36.

The first conventional torque-limiting driver has torque-limiting means installed in the interior of a body so locking torque can be avoided being adjusted improperly, having an advantage that the equilibrium of locking torque can be achieved but a disadvantages that the torque-limiting means has to be disassembled in order to carry out torque adjustment. However, the second and the third conventional torque-limiting driver seen most frequently on the market can be freely adjusted by a user, unnecessary to disassemble the driver. But the first conventional torque-limiting driver has a complicated structure that the adjustment plug and the locking plate have to be produced independently and separately, increasing assembly work.

SUMMARY OF THE INVENTION

The objective of this invention is to offer a lockable torque-limiting driver, able to quickly and accurately adjust the torque of the torque-limiting driver. When being adjusted, the torque-limiting driver will give out sounds by which a user is able to know an extent of torque adjustment and stop adjusting work in due time, needless to test the torque adjusting extent repeatedly.

The torque-limiting driver of this invention is to have the inner wall of a sleeve disposed with a plurality of lengthwise recessed grooves for fixing an upper cam to let the upper cam operated together with the sleeve.

The torque-limiting driver of this invention has the inner wall of the sleeve formed with female threads for locking and restricting a torque-limiting member.

The torque-limiting driver of this invention has the upper side of the sleeve disposed with a plurality of positioning serrations to be coupled with the positioning projections of the torque-limiting member to enable the torque-limiting member to be turned and adjusted by a user's fingers but restricted the torque-limiting member not to rotate reversely.

The torque-limiting driver of this invention is to have the positioning projections of the torque-limiting member actuated to move on the positioning serrations of the sleeve and produce sounds when the torque-limiting member is turned by a user's fingers. Thus, by the sounds, the user is able to know a torque limiting extent desired, needless to use any external tool and able to carry out torque adjustment quickly and accurately.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
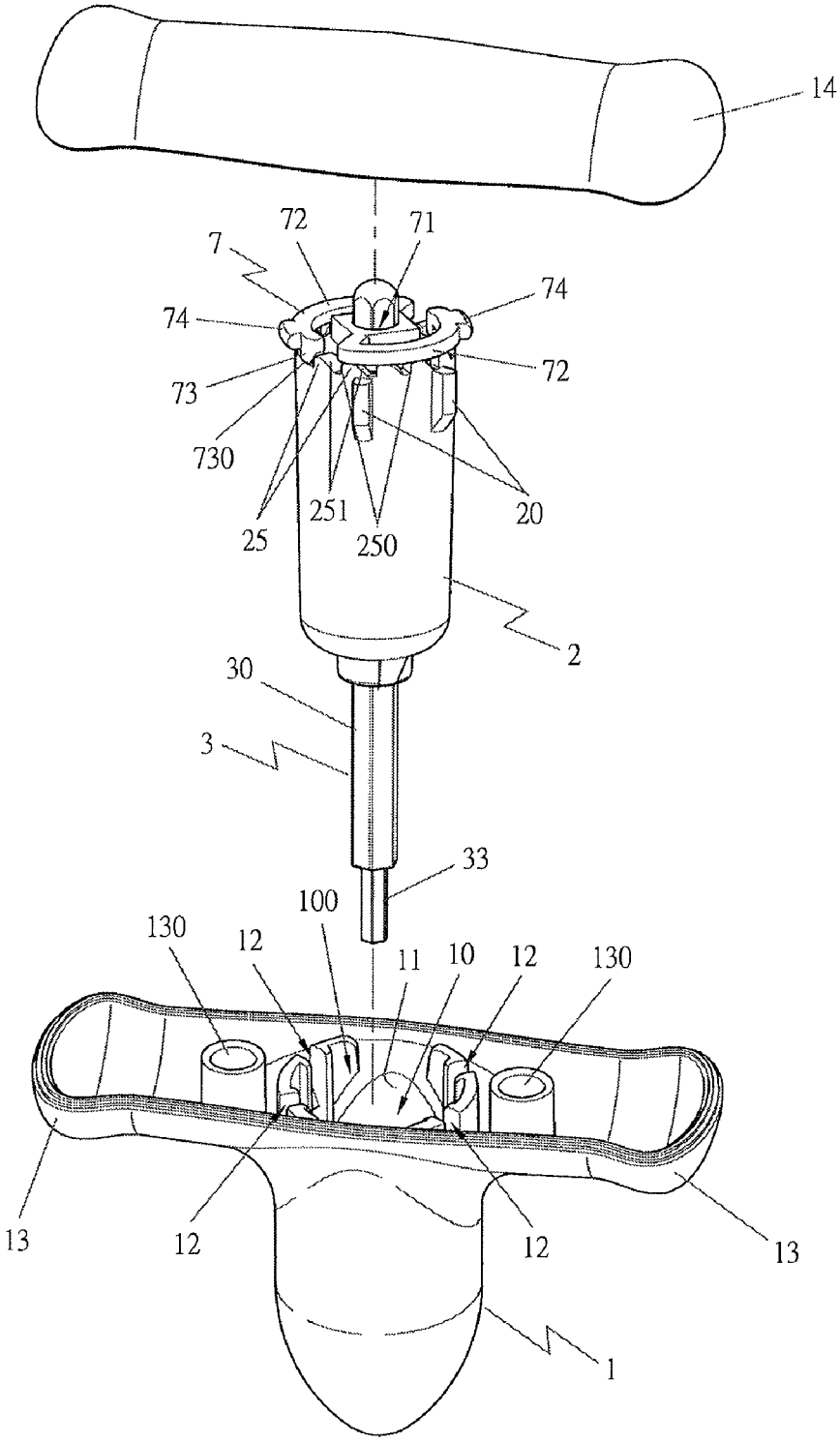
FIG. 1 is an exploded perspective view of a lockable torque-limiting driver in the present invention.
Figure 2:
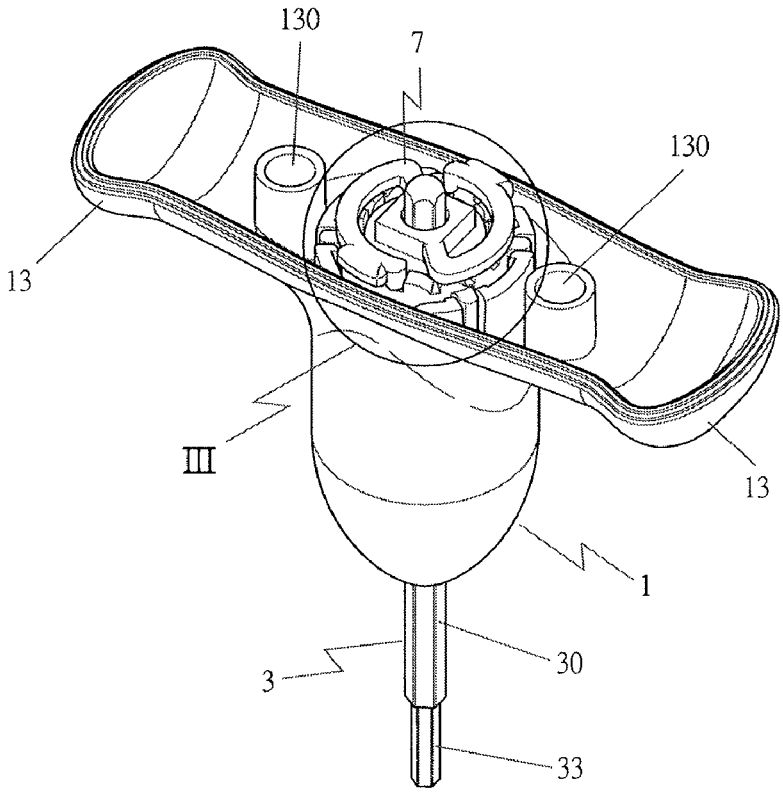
FIG. 2 is a partial perspective view of the lockable torque-limiting driver in the present invention.
Figure 3:
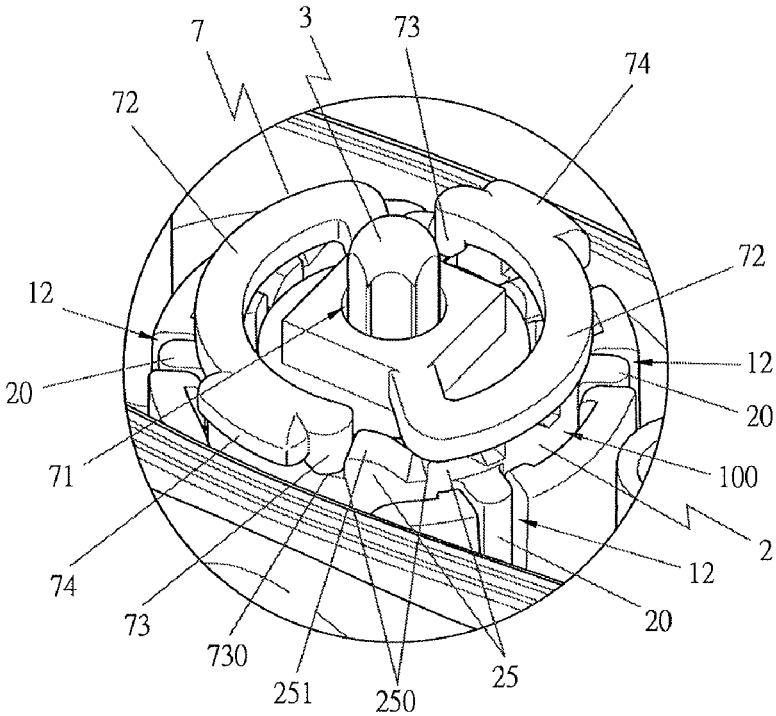
FIG. 3 is a partial magnified view of the part III in FIG. 2.

A preferred embodiment of a lockable torque-limiting driver in the present invention, as shown in FIGS. 1 to 4, includes a body 1, a sleeve 2, a locking stem 3, an upper cam 4, a lower cam 5, a compression spring 6 and a torque-limiting member 7 as main components combined together.

Figure 4:
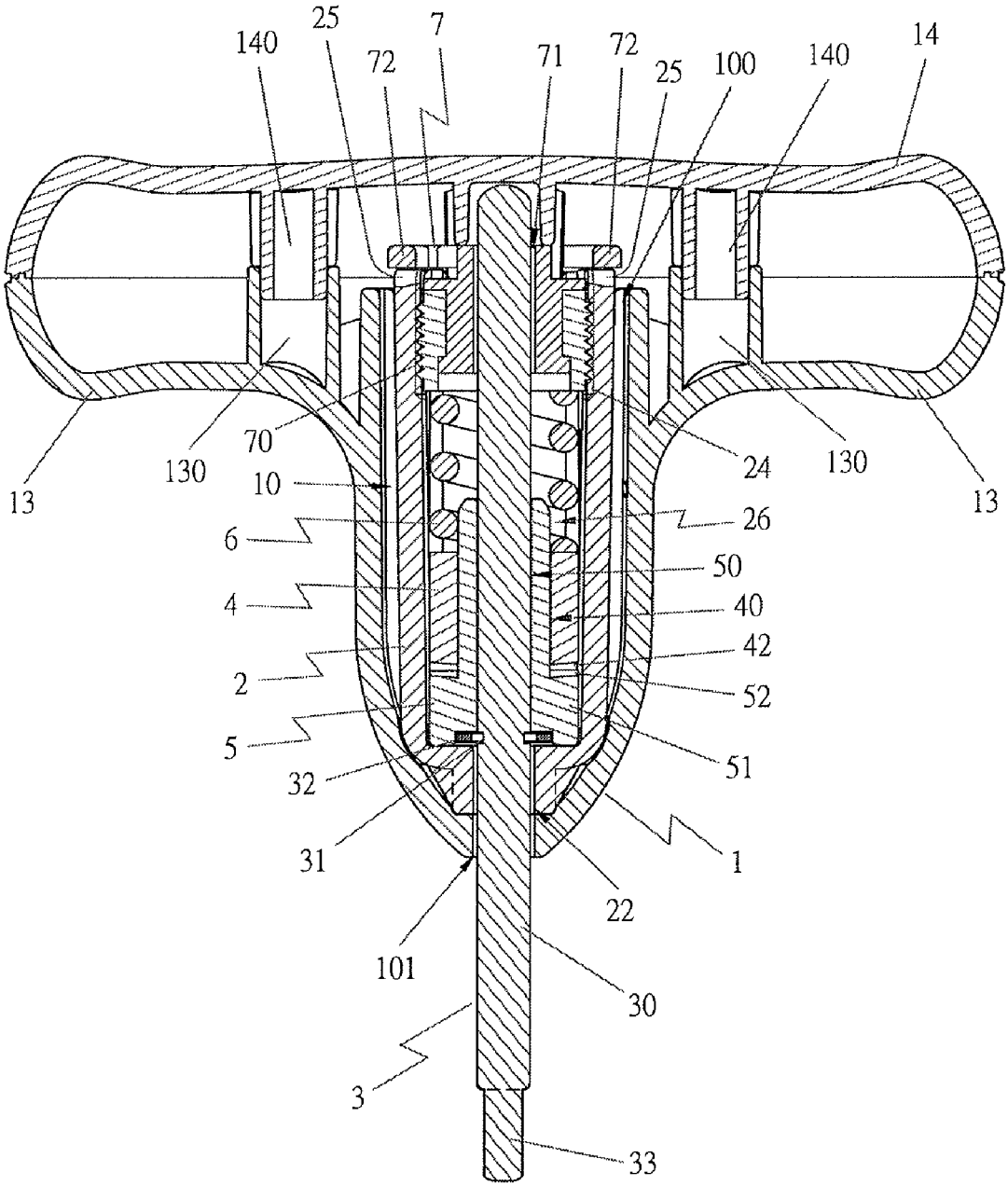
FIG. 4 is a cross-sectional view of the lockable torque-limiting driver in the present invention.

The body 1 is provided with a sleeve chamber 10 with an upper large opening 100 and a lower small opening 101, as shown in FIG. 4, for matching with the shape of the sleeve 2. The sleeve chamber 10 has its inner wall 11 disposed with a plurality of lengthwise recesses 12 for the projecting edges 20 of the sleeve 2 to be respectively fitted therein to fix the body 1 and the sleeve 2 together. The body 1 has two upper sides respectively extending leftward and rightward to form an extension member 13 with two combination holes 130. A cover 14 with a shape symmetrical with the extension members 13 is disposed with combination studs 140 at the inner side. Thus, after the cover 14 is covered on the body 1, the combination studs 140 of the cover 14 will be respectively fitted tightly in the combination holes 130 of the body 1 to combine the cover 14 together with the body 1.

Figure 5:
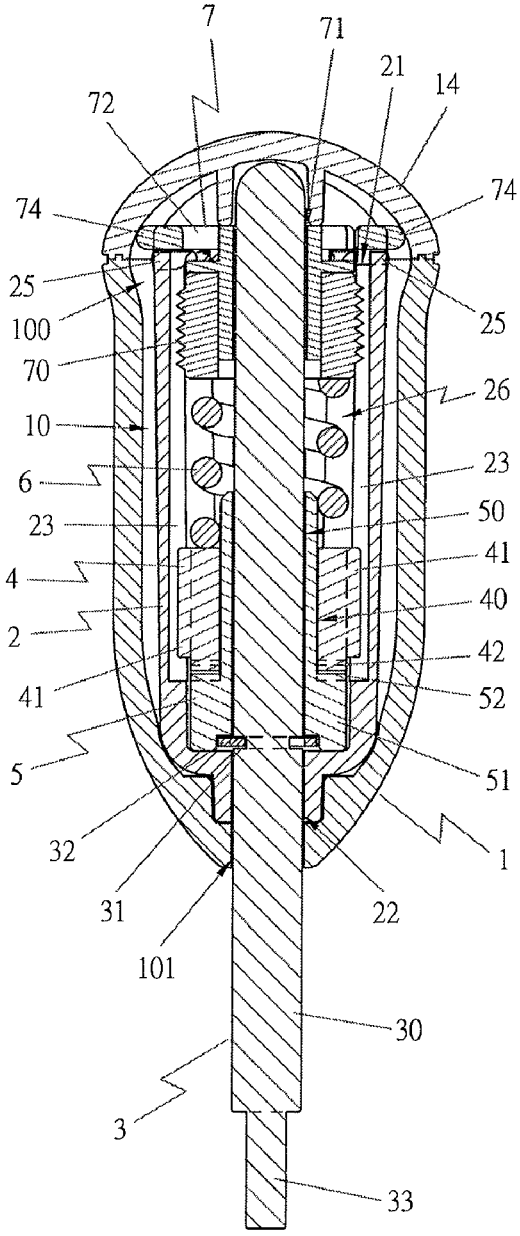
FIG. 5 is a side cross-sectional view of the lockable torque-limiting driver in the present invention.
Figure 6:
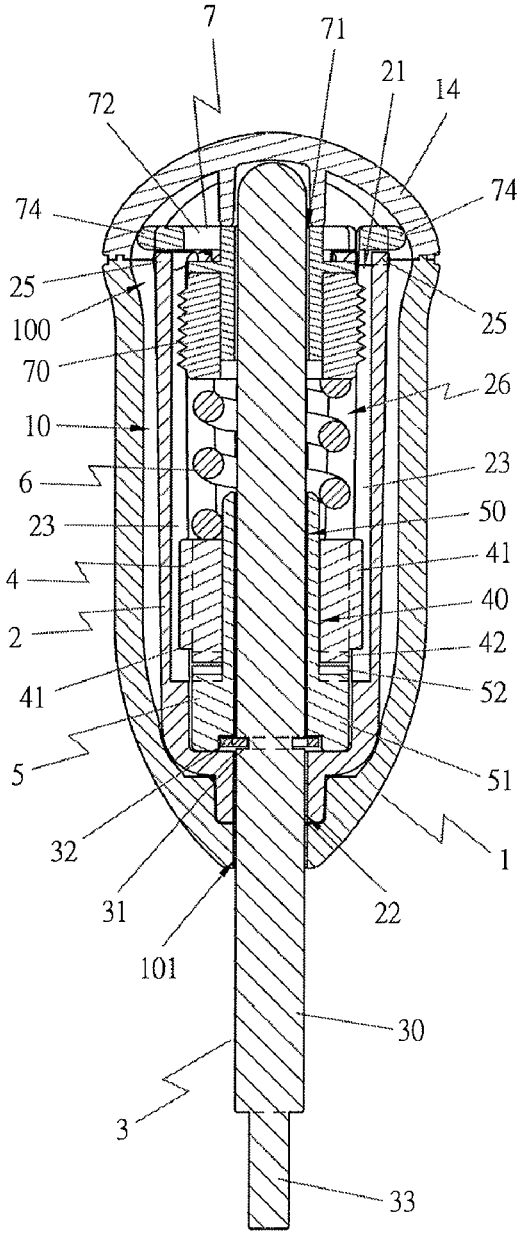
FIG. 6 is a side cross-sectional view of the lockable torque-limiting driver in operating condition in the present invention.
Figure 7:
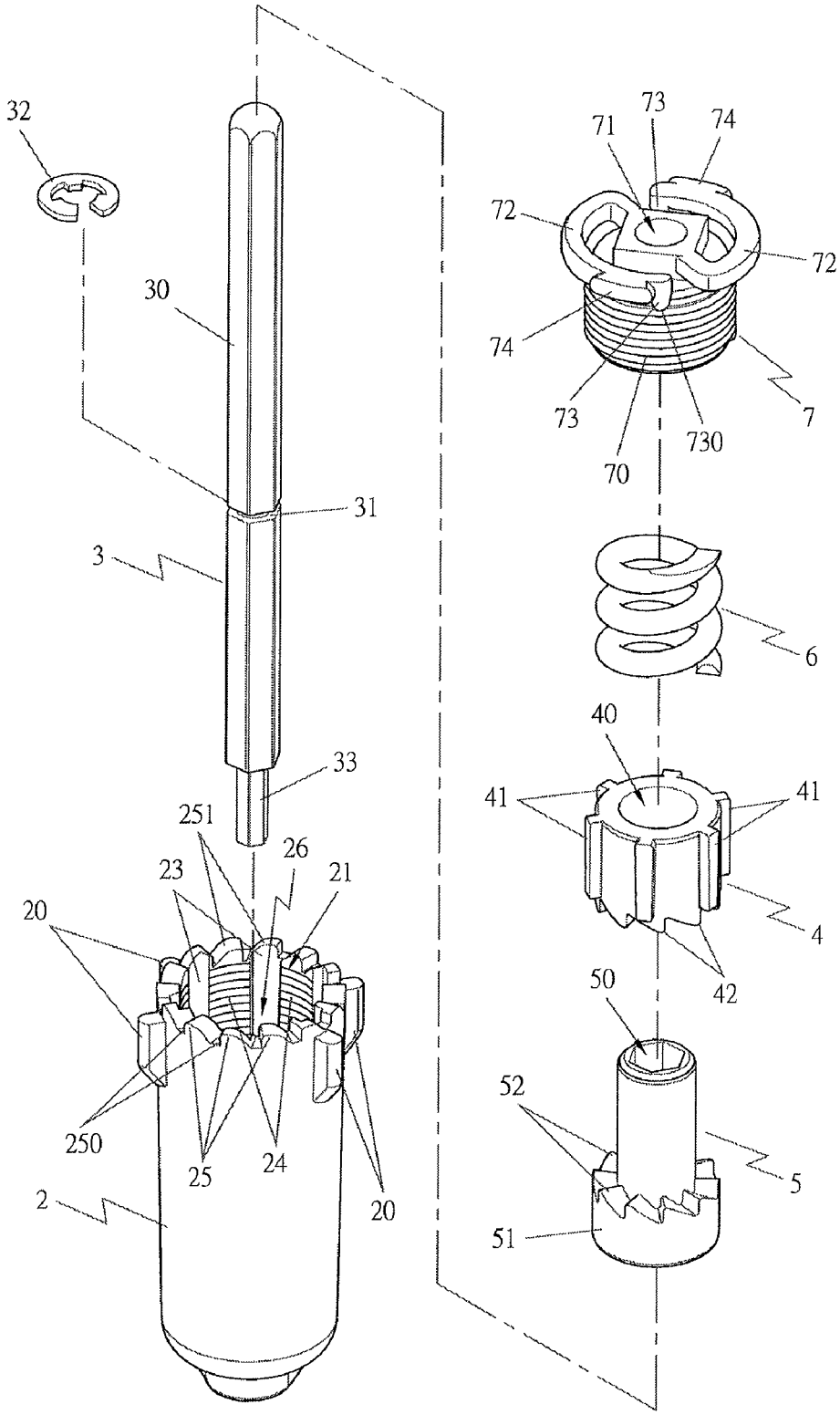
FIG. 7 is a partial exploded perspective view of the lockable torque-limiting driver in the present invention.
Figure 8:
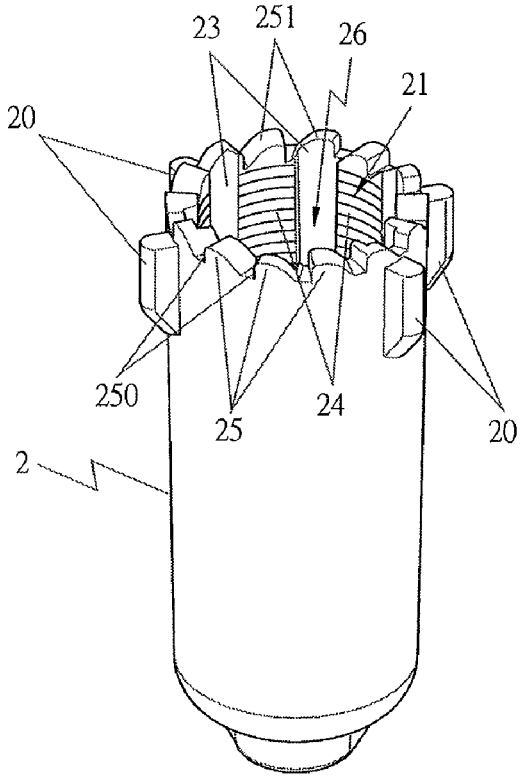
FIG. 8 is a perspective view of a sleeve of the lockable torque-limiting driver in the present invention.
Figure 9:
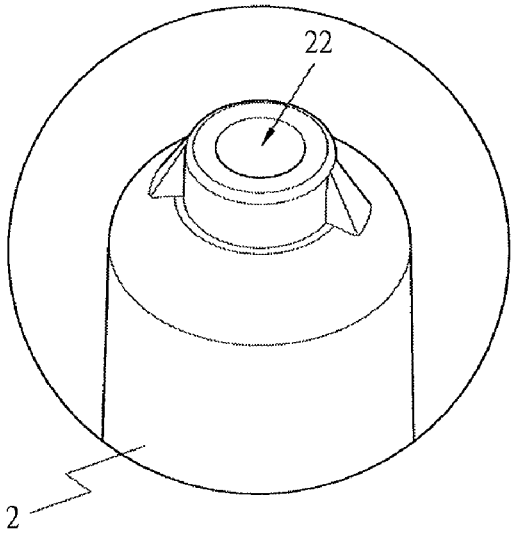
FIG. 9 is a perspective view of the bottom of the sleeve in the present invention.

The sleeve 2, referring to FIGS. 5 to 9, has its outer wall formed thereon with a plurality of lengthwise projecting edges 20 to be respectively fitted in the recesses 12 of the body 1 for combining the sleeve 2 and the body 1 together. The sleeve 2 is formed with an upper large opening 21 and a lower small opening 22, as shown in FIGS. 8 and 9, for the locking stem 3 to be inserted therethrough, having its inner wall bored with a plurality of lengthwise recesses 23 for receiving the upper cam 4 to restrict the upper cam 4 to move together with the sleeve 2, and formed with female threads 24 to be engaged with the male threads 70 of the torque-limiting member 7 for restricting and controlling locking torque of the torque-limiting driver. Further, the sleeve 2 has its upper annular side formed thereon with a plurality of positioning serrations 25 respectively provided with an upright face 250 and an arcuate face 251 that extends backward obliquely from the uppermost end of the upright face 250, also formed inside with a center chamber 26, as shown in FIGS. 4 and 5, for receiving the upper cam 4, the lower cam 5, the compression spring 6 and the torque-limiting member 7 together therein.

The locking stem 3, as shown in FIGS. 5, 6 and 7, is formed with a hexagonal stem portion 30 with a C-shaped retaining recess 31 for a C-shaped retainer 32 to be clasped therein for restrictedly positioning the upper cam 4, the lower cam 5 and the compression spring 6. The locking stem 3 is provided with a lower locking end 33, which can be blade-shaped, cross-shape, hexagonal-shaped or star-shaped.

The upper cam 4 is bored with a through insert hole 40 in the center for the locking stem 3 to be inserted therethrough, having its outer wall provided with a plurality of lengthwise projections 41 to be respectively fitted in the recessed grooves 23 of the sleeve 2, letting the upper cam 4 restricted by the sleeve 2 and impossible to be rotated. The upper cam 4 has a lower end set with one-way serrations 42 for matching with the operation of the lower cam 5.

The lower cam 5 is bored with a hexagonal through insert hole 50 for the hexagonal stem portion 30 of the locking stem 3 to be inserted therethrough for fixedly combining the lower cam 5 together with the stem portion 30 of the locking stem 3, letting the lower cam 5 operated together with the locking stem 3. Further, the lower cam 5 is formed with a larger annular member 51 having its upper surface provided with one-way serrations 52 to be engaged with the one-way serrations 42 of the upper cam 4. Under a normal locking torque operating condition, the one-way serrations 52 of the lower cam 5 will be completely engaged with the one-way serrations 42 of the upper cam 4, and when a user operates this torque-limiting driver according to a torque value preset, the body 1, the sleeve 2 and all the other members will simultaneously be driven to rotate for carrying out locking work.

The compression spring 6 is positioned between the topside of the upper cam 4 and the torque-limiting member 7 for the locking stem 3 to be inserted therethrough.

Figure 10:
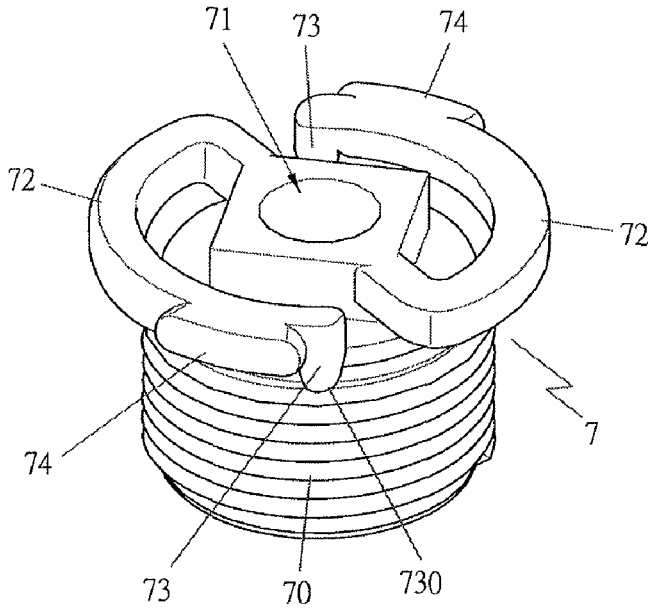
FIG. 10 is a perspective view of a torque-limiting member in the present invention.
Figure 11:
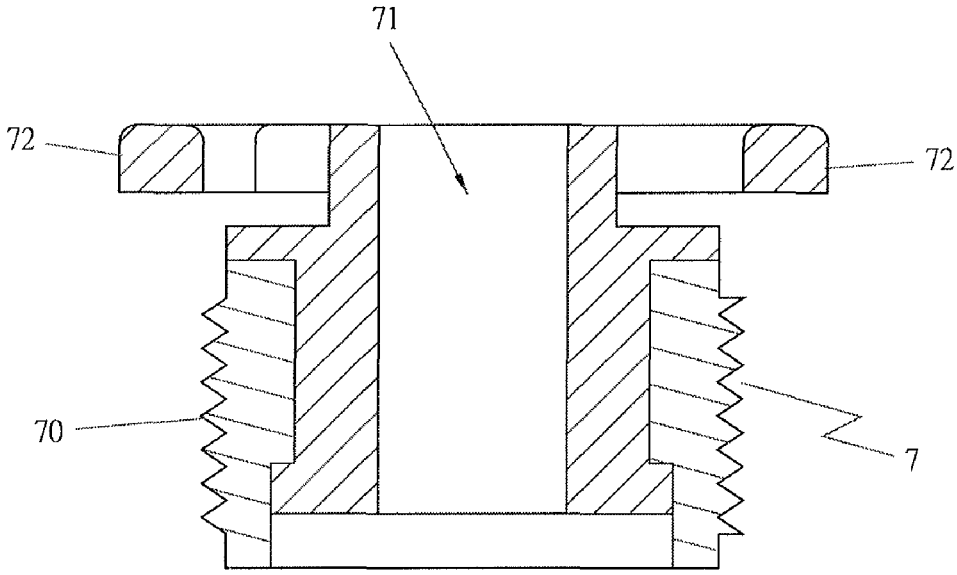
FIG. 11 is a cross-sectional view of the torque-limiting member in the present invention.

The torque-limiting member 7, as shown in FIGS. 7, 10 and 11, is provided with male threads 70 to be screwed with the female threads 24 of the sleeve 2 and bored with a through insert hole 71 in the center for the locking stem 3 to be inserted therethrough, having its upper side provided with two extension curved portions 72 respectively having its one end disposed with a positioning projection 73 respectively formed with a curved surface 730. Each extension portion 72 is further formed thereon with actuating members 74 by which a user can move around the torque-limiting member 7 with fingers.

Figure 12:
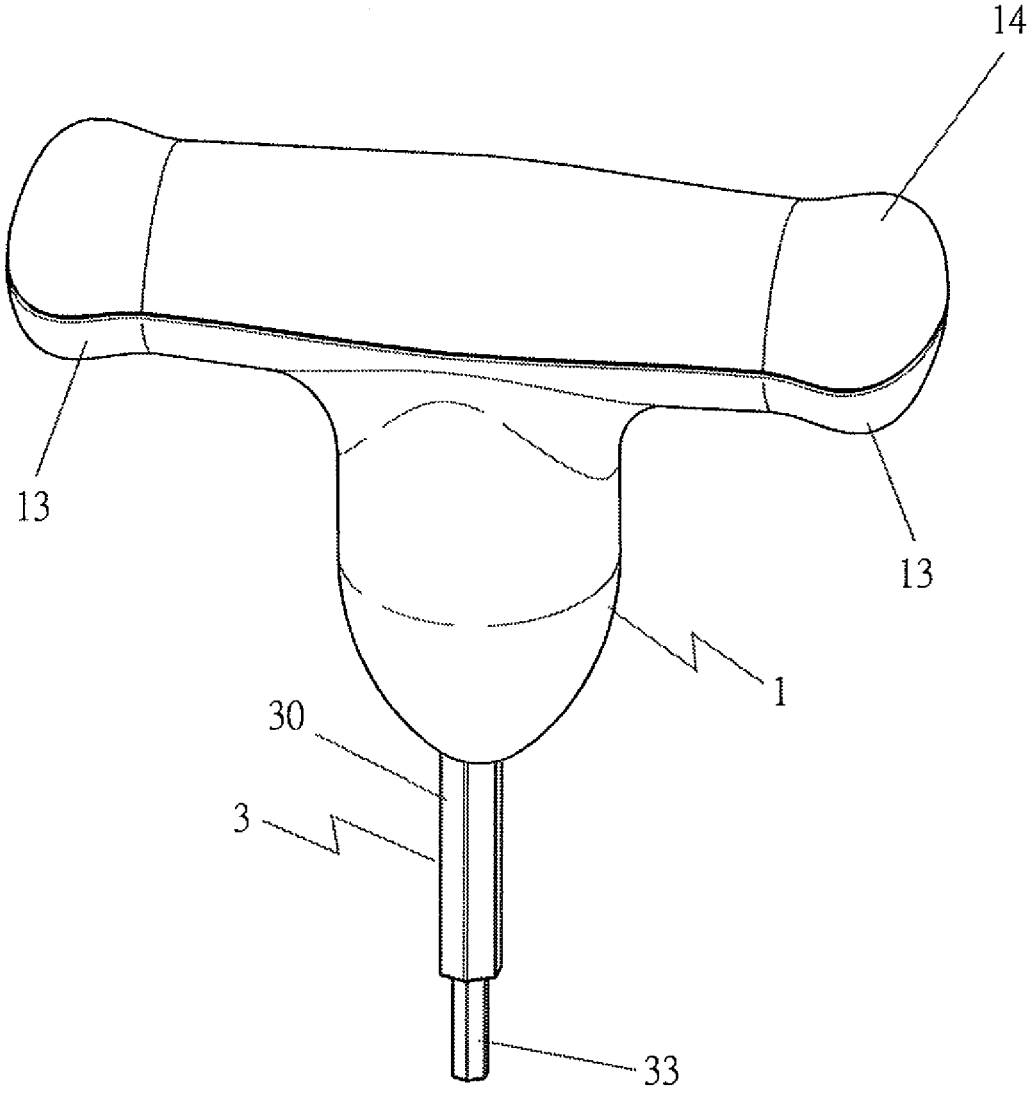
FIG. 12 is a perspective view of the lockable torque-limiting driver in the present invention.

In assembling, referring to FIGS. 5, 6 and 7, firstly, the C-shaped retainer 32 is clasped in the C-shaped retaining recess 31 of the locking stem 3, and the lower cam 5, the upper cam 4 and the compression spring 6 are orderly fitted on the upper portion of the locking stem 3 and then position all the foresaid members in the center chamber 26 of the sleeve 2 to have the projections 41 of the upper cam 4 respectively fitted in the recessed grooves 23 of the sleeve 2, letting the upper cam 4 restrictedly operated together with the sleeve 2. Next, the torque-limiting member 7 is threadably combined together with the sleeve 2 and thus, a user is able to turn the torque-limiting member 7 with fingers by means of the actuating members 74 of the torque-limiting member 7. At this time, the positioning projections 73 of the torque-limiting member 7 will be actuated to move on the positioning serrations 25 of the sleeve 2 and give out sounds by which the user is able to know a torque limiting extent desired, unnecessary to use any external tool and able to carry out torque adjustment quickly and accurately. Lastly, the foresaid members are all combined together with the body 1, and the upper cover 14 is covered on the topside of the body 1 to finish assembly of the lockable torque-limiting driver, as shown in FIGS. 4 and 12, and meanwhile the torque of the lockable torque-limiting driver has been already adjusted to a proper extent.

To use the torque-limiting driver of this invention for adjusting the screw inside a golf club head, as shown in FIG. 5, a user can turn the torque-limiting driver within a desired range of torque and use the locking stem 3 to lock the screw of the golf club head. But, when the user adjusts the torque-limiting driver to an extent exceeding a desired torque value, as shown in FIG. 6, the upper cam 4 will produce a moving-up strength to squeeze the compression spring 6, letting the upper cam 4 disengaged from the lower cam 5 and thus, the lower cam 5 and the locking stem 3 will be disconnected from the driving power of the upper cam 4. At this time, even though the user should turn the torque-limiting driver to actuate the body 1 and the sleeve 2 to rotate continuously, the locking stem 3 would be kept in a non-rotation condition, able to protect the locked screw of the golf club head and avoid affecting equilibrium of ball striking.

While the preferred embodiment of the invention has been described above, it will be recognized and understood that various modifications may be made therein and the appended claims are intended to cover all such modifications that may fall within the spirit and scope of the invention.

I claim:

1. A lockable torque-limiting driver comprising:

a body formed with a sleeve chamber for receiving a sleeve therein, said body disposed with a plurality of lengthwise recesses in an inner wall, said body covered thereon with an upper cover;

said sleeve provided with a plurality of lengthwise projecting edges on an outer wall, said projecting edges respectively fitted in said recesses of said body, said sleeve bored with plural recessed grooves at an inner wall for fixing an upper cam, said sleeve formed with female threads at the inner wall for coupling a torque-limiting member, said sleeve formed with plural positioning serrations at an upper edge, a center chamber formed in an interior of said sleeve for orderly receiving a lower cam and said upper cam and a compression spring together with said torque-limiting member therein;

a locking stem formed with a hexagonal stem portion, said stem portion cut with a C-shaped retaining recess for clasping a C-shaped retainer therein, said locking stem disposed with a lower locking end;

said upper cam bored with a through insert hole in the center for said locking stem to be inserted therethrough, said upper cam provided with plural lengthwise projections on an outer wall to be respectively fitted in said recessed grooves in the inner wall of said sleeve, said upper cam having a lower end set with one-way serrations for matching with said lower cam;

said lower cam bored with a hexagonal through insert hole in the center for said hexagonal stem portion of said locking stem to be inserted therethrough, said lower cam provided with a large annular member having one-way serrations formed thereon, said one-way serrations of said lower cam engaged with said one-way serrations of said upper cam;

a compression spring positioned between an upper side of said upper cam and said torque-limiting member for said locking stem to pass therethrough; and said torque-limiting member formed with male threads to be screwed with said female threads inside said sleeve, said torque-limiting member bored with a through insert hole in a center for said locking stem to pass therethrough, said torque-limiting member formed with two extension curved portions respectively having an outer side formed with a positioning projection, said extension curved portions respectively formed thereon with an actuating member to be turned by user's fingers for rotating said torque-limiting member.

2. The lockable torque-limiting driver as claimed in claim 1, wherein said body has two opposite sides respectively provided with an extension member with a combination hole, and said upper cover is formed inside with combination studs, said combination studs of said upper cover respectively combined with said combination holes of said extension members of said body to combine said upper cover with said body together.

3. The lockable torque-limiting driver as claimed in claim 1, wherein said positioning serrations of said sleeve are respectively formed with an upright face and an arc-shaped face that slants backward from an uppermost end of said upright face.

4. The lockable torque-limiting driver as claimed in claim 1, wherein each said positioning projection of said torque-limiting member is formed with an arc-shaped end.

5. The lockable torque-limiting driver as claimed in claim 1, wherein said positioning projections of said torque-limiting member are actuated to move on said positioning serrations of said sleeve and give out sounds by which a user is able to know a desired value of torque adjustment.

* * * * *